US007971593B2

(12) United States Patent
Bartels

(10) Patent No.: US 7,971,593 B2
(45) Date of Patent: Jul. 5, 2011

(54) HAIR ROLLERS

(75) Inventor: Holger Bartels, Hamburg (DE)

(73) Assignee: Henkel KGaA, Düsseldorf (DE)

( * ) Notice: Subject to any disclaimer, the term of this patent is extended or adjusted under 35 U.S.C. 154(b) by 701 days.

(21) Appl. No.: 11/547,337

(22) PCT Filed: Sep. 17, 2004

(86) PCT No.: PCT/EP2004/010425
§ 371 (c)(1),
(2), (4) Date: Jun. 3, 2008

(87) PCT Pub. No.: WO2005/096873
PCT Pub. Date: Oct. 20, 2005

(65) Prior Publication Data

US 2008/0236610 A1 Oct. 2, 2008

(30) Foreign Application Priority Data

Apr. 10, 2004 (DE) ..... 10 2004 017 626

(51) Int. Cl.
*A45D 2/00* (2006.01)

(52) U.S. Cl. ..... 132/245

(58) Field of Classification Search ..... 132/245, 132/246, 250, 251, 252, 253, 254, 260, 264, 132/267, 162; D28/35, 37
See application file for complete search history.

(56) References Cited

U.S. PATENT DOCUMENTS

| | | | | |
|---|---|---|---|---|
| 2,388,628 | A | 11/1945 | Wormington | |
| 2,789,565 | A | 4/1957 | Voorhees | |
| 2,910,989 | A * | 11/1959 | Russell | 132/252 |
| 3,007,477 | A | 11/1961 | Vernon | |
| 3,105,503 | A | 10/1963 | Safianoff | |
| 3,161,202 | A | 12/1964 | Mecca | |
| 3,442,271 | A | 5/1969 | D'Angio | |
| 3,618,620 | A | 11/1971 | Williams | |
| 4,317,461 | A * | 3/1982 | Anderson | 132/233 |
| 5,033,487 | A | 7/1991 | Barradas | |
| 2002/0066460 | A1 * | 6/2002 | Johnson et al. | 132/200 |

FOREIGN PATENT DOCUMENTS

| | | |
|---|---|---|
| DE | 822 885 | 11/1951 |
| DE | 953 906 | 12/1956 |
| DE | 1 010 708 | 6/1957 |
| DE | 1 032 486 | 6/1958 |
| DE | 1 090 400 | 10/1960 |
| DE | 1 279 293 | 10/1968 |
| GB | 608193 | 9/1948 |

* cited by examiner

*Primary Examiner* — Rachel Steitz
(74) *Attorney, Agent, or Firm* — Connolly Bove Lodge & Hutz LLP

(57) ABSTRACT

The invention relates to a hair roller (1) having a central roller mandrel (3) and a partially slotted hair roller housing (2) that surrounds the roller mandrel at a distance. Said hair roller fixes the hair in the vicinity of the scalp by means of catch hooks and is positioned approximately at a right angle to the scalp in the final wound position.

27 Claims, 13 Drawing Sheets

HAIR ROLLERS

RELATED APPLICATIONS

This application is a national stage application (under 35 U.S.C. 371) of PCT/EP2004/010425, filed Sep. 17, 2004, which claims benefit of German application 10 2004 017 626.4, filed Apr. 10, 2004.

Hair rollers of the generic type are known, for example, from DE Patent 953 906 or DE Patent 1 090 400. In this case, small arms for fixing the roller on the hair strands emerging from the scalp are driven outward by means of a push rod when the rolling operation is ended, with the hair strand being rolled up onto the outside wall of a cylindrical roller body.

DE-B 1 279 293 shows a hair roller with a base which has a base plate and a marginal web and also an introductory slot for a hair strand, a centric pin, onto which a hair holder can be placed, and a rotatable cage which can be fixed in place by a catch lever after the rolling operation.

U.S. Pat. No. 3,618,620 shows a similar construction, but the roller cage here has to be fixed in place by means of an additional hood after the rolling operation.

With regard to fixing a roller in a position situated approximately perpendicularly to the scalp, mention should also be made of DE Patent 1 010 708, DE Patent 1 032 486 or U.S. Pat. No. 2 388 628. Furthermore, DE-822 885 or U.S. Pat. No. 5,033,487 belong to the technique of rolling on cylindrical roller bodies.

If the roller mechanisms are locked by means of a clamping effect, the hair cannot be prevented from obtaining kinks, and so there is the risk of hair breaking. Rollers which have gripping arms for locking avoid such a problem. However, these rollers have the disadvantage that different rolling radii have to be accepted. The rolling direction means that the greatest degree of frizziness occurs at the free end of the hair, since the latter is grasped first during the rolling-up operation and therefore takes up the smallest radius.

A further disadvantage of many rollers in the prior art resides in the multiplicity of elements which make production complicated and therefore expensive.

It is therefore the object of the present invention to eliminate the disadvantages of the prior art.

This object is achieved by a hair roller of the type described at the beginning by means of the characterizing features of the main claim.

A hair roller of the present invention has a roller spindle, a base plate and a roller housing with gripping arms. In an embodiment of the invention, the roller spindle and the baseplate, for example, can be configured as a single part, so that the entire roller only comprises two parts. In this case, the base plate has an entry slot through which the hair strand to be wound up can be guided into the roller. Furthermore, the base plate has a marginal web which serves firstly as a guide for the roller housing and secondly as a handling element for the user. In the present invention, the roller housing has at least one slot through which the hair strand to be wound up is guided out of the roller housing again.

Owing to the fact that the roller comprises only a very small number of parts, for example two parts, namely an element which provides the slotted base plate and the roller spindle, and another element which provides a roller housing with the gripping arms necessary for fixing, production is greatly simplified. Handling is also facilitated, since the person using it merely has to move one element in order both to wind and to fix said roller. An enclosure around it is therefore unnecessary, and so the rolling duration is also optimized.

Further refinements of the invention emerge from the subclaims. It may be advantageous if the gripping arms are set at an angle of $\leqq 90°$ relative to the outer casing region of the roller housing. With the rolling-up rotational movement, it is then possible for the gripping arms to be able easily to slide in the corner region between baseplate and marginal region without building up too great a rotational resistance.

In order to facilitate the emergence of the gripping arms during a rotation of the roller housing counter to the rolling-up direction, the invention furthermore makes provision for the slots in the transition region between the marginal web and the base plate to be provided with tapered bevels for the free ends of the gripping arms.

If a particularly short reverse rotation is desired, it may be expedient to choose the number of slots to be greater than the number of gripping arms, so that the latter, during reverse rotation, can enter the region of the hair roots as rapidly as possible from the exit openings.

An expedient refinement of the invention also consists in the roller housing, in the region of the free end of the roller spindle, and/or in the transition region between the marginal web and the baseplate, being fixed in the usage position by latching or clamping.

The roller spindle may also be conically configured in order to ensure an evening out of the radius of curvature of the rolled-up hair strand from the beginning to the tip. A conical configuration of this type also ensures that it is easier to pull off the wavy strand when it is ready.

In order further to simplify the pulling off of the curly hair strand when it is ready, it may be advantageous to design the surface of the roller spindle to be low in friction. A low-friction design of this type can be formed, for example, by a coating.

A further expedient refinement of the invention also consists in the roller spindle being made of a different material from the base plate. It may also be advantageous for the roller spindle to have a structure, for example, for better fixing while rolling up the hair strand. A structure of this type may additionally, for example, also influence the appearance of the finished curls.

Furthermore, it may be expedient to design the roller spindle to be hollow on the inside. If the roller spindle is additionally provided, for example, with radial bores, then the permanent-wave-producing product to be applied, in addition to the customary variant from the outside, can also be applied directly to the hair strand from the inside, through the hollow roller spindle and through the radial bores. For this application method, it may be advantageous for the upper opening in the roller spindle to be tailored to the connection of a product container. Such a purposeful application of fluid to be applied to the hair can afford the advantage, for example, that substantially less of this fluid is required to obtain the desired effect.

Also, it may be expedient to purposefully distribute the radial bores on the roller spindle in such a manner that more or less heavily waved areas are produced on the hair strand.

In order to improve the guidance of the hair strand during the rolling operation, it may be advantageous to configure at least one cutout of the roller housing in a manner such that it widens in the upward direction. Furthermore, it may be advantageous for a hair roller according to the invention that the gradient of these beveled slots is chosen such that, by rotation of the roller housing, the hair strand is transported in the direction of the upper end of the roller spindle. As a result, a bunching of hair in the lower region of the roller during the rolling operation can be prevented.

Furthermore, it may be a further advantage for the roller housing to have further openings in addition to the slots. These openings are advantageous if the hair strand is to be rinsed through in the rolled-up state. This rinsing through can be further improved by a hair roller according to the invention being configured at the upper end of its hollow roller spindle for connection to a rinsing device. As a result, the rolled-up hair strand can be fully rinsed through from the inside to the outside.

Depending on the region of use of a hair curler according to the invention, it may be advantageous to design the roller housing to be thermally insulating. This thermal insulation can be produced, for example, by the roller housing consisting of a heat-insulating material. Within the context of the present invention, a heat-insulating coating of the roller housing is also possible. When the present invention is used to produce permanent waves, a thermal insulation temperature raises the reaction temperature in the hair strand and therefore reduces the reaction time. As a result, the duration during which the hair rollers have to remain on the hair is reduced.

Depending on the length of the hair strand to be treated, it may be advantageous to use different sizes of a hair roller according to the invention. The internal volume of the roller housing can be matched in accordance with the length and volume of the hair strand to be treated.

A further expedient refinement of the invention also consists in the base plate of the roller spindle being configured with feet. These feet act as spacers between the base plate and the scalp. Furthermore, it may also be advantageous to provide the base plate of the roller spindle with a concave curvature. Both as a result of this distancing and as a result of the concave configuration, a hair reservoir is formed beneath the mounted hair roller. This prevents individual hairs of the hair strand becoming jammed under the baseplate between the latter and the scalp.

It is also possible, within the context of the present invention, to make these feet from a soft material which does not injure the scalp. In this embodiment of the invention, the hair roller obtains a fixed and secure support on the scalp by means of the feet.

A further advantageous refinement of the present invention can have, for example, tapers on the gripping arms, which facilitate the engagement of the gripping arms in the exit openings. These tapers therefore form a type of kink or joint replacement for the gripping arms.

Furthermore, it may be advantageous for the gripping arms to extend from the roller housing downwards parallel to the roller spindle. In such an embodiment of the invention, it may furthermore be advantageous to integrate the exit openings in the base plate in such a manner that the gripping arms engage in the hairs under the baseplate in the hair reservoir.

Furthermore, it may be expedient to design a hair roller according to the invention in such a manner that it has an additional clamping device, which allows the hair roller also to be used according to a conventional application method.

Further features, details and advantages of the invention emerge on account of the description below and the drawings.

The latter show, in three-dimensional illustrations, in

FIG. 1 a plan view of a hair roller according to the invention;

FIG. 2 a view from below of a hair roller according to the invention;

Figure 1:
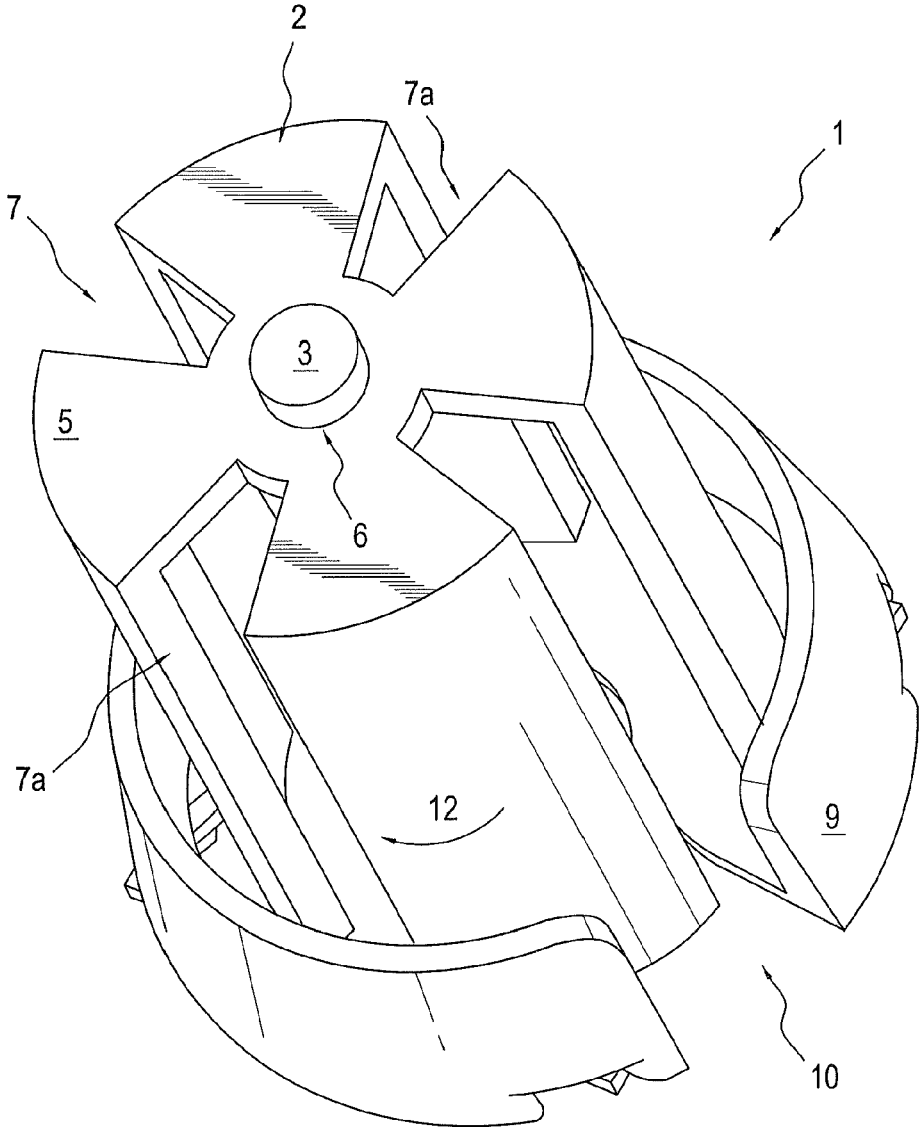
Figure 2:
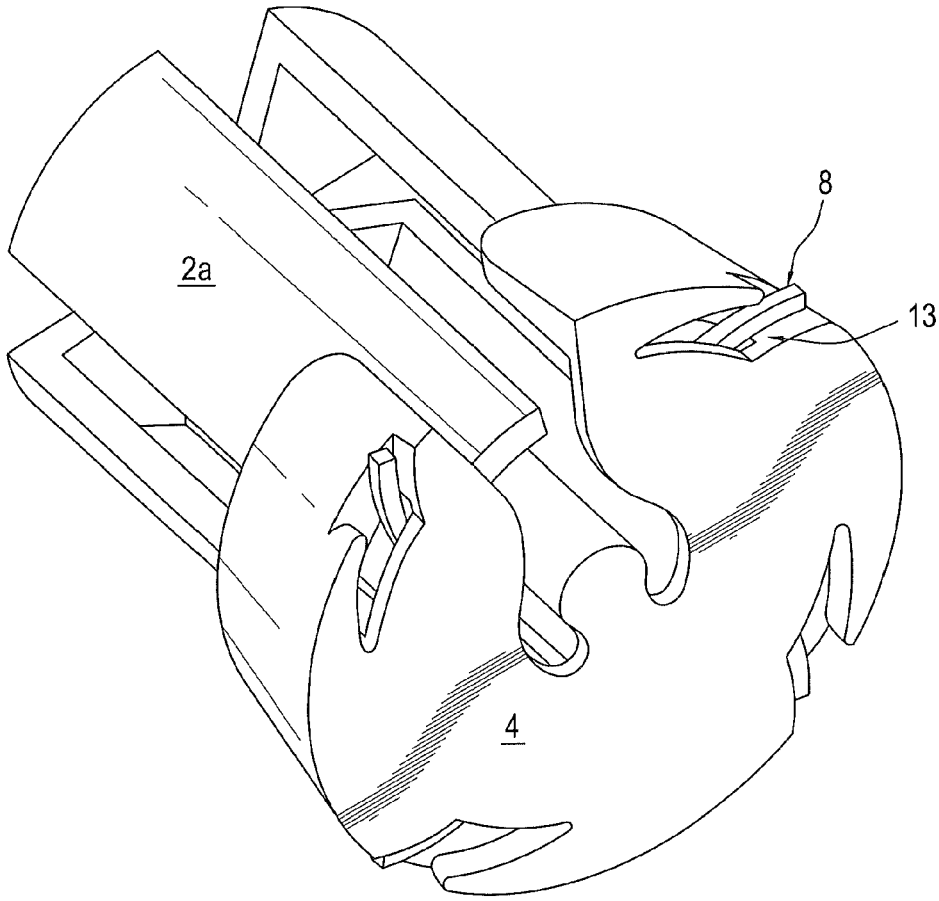
Figure 3:
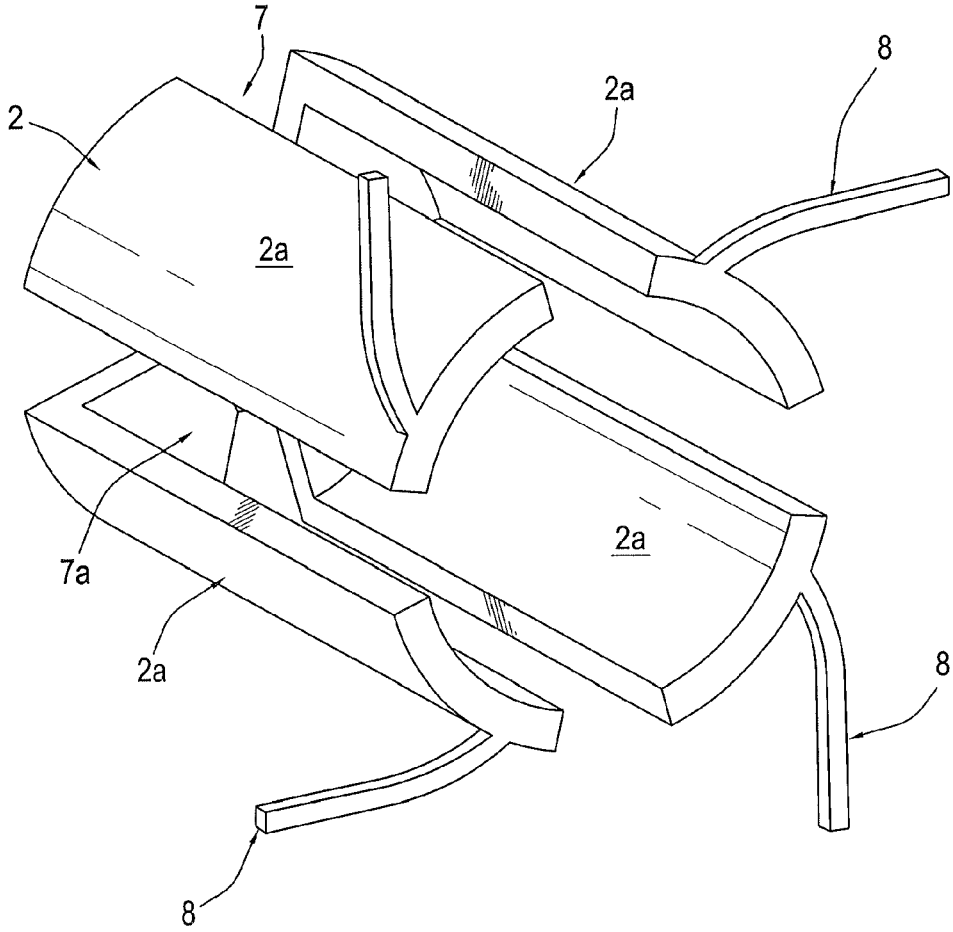
FIG. 3 shows a roller housing of a hair roller according to the invention with gripping arms.
Figure 4:
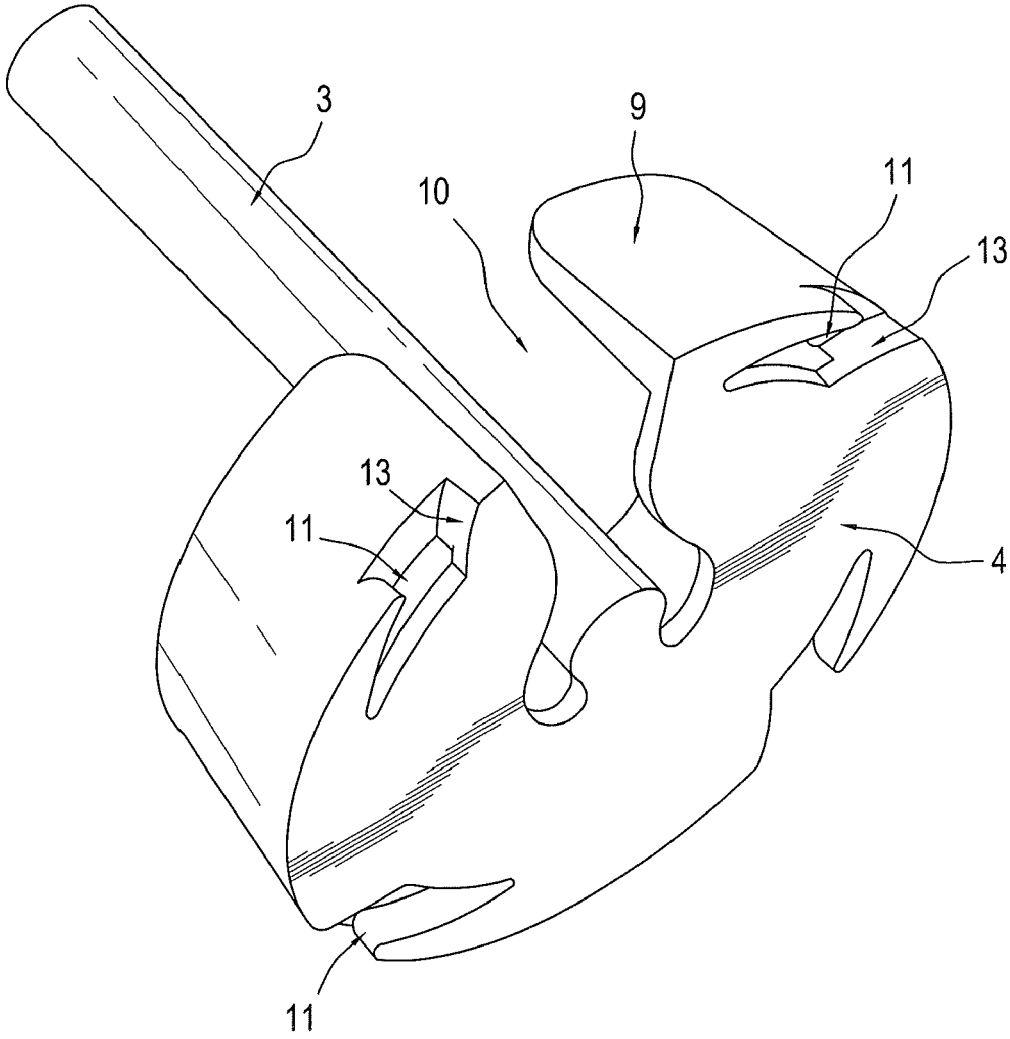
FIG. 4 shows a roller spindle with a baseplate of a hair roller according to the invention.

In an embodiment according to FIGS. 1 to 5, the general hair roller, which is referred to by 1, comprises two plastic parts, to be precise, a roller housing 2, which is illustrated separately in FIG. 3, and a roller spindle 3, illustrated in more detail in FIG. 4, with a baseplate 4 which is integrally formed as a single piece on it, which parts are joined together in the usage position, as emerges from FIGS. 1 and 2. In the example illustrated, the roller housing 2 is of approximately cup-shaped configuration, with the cup base, which is referred to by 5 in FIG. 1, having a pass-through opening 6 for the upper part of the roller spindle 3, and four cutouts 7 which merge into slots, which are referred to by 7*a*, in the cup wall in such a manner that four roller-housing wall surface elements 2*a* are produced. Gripping arms 8 are integrally formed as a single piece on the free ends of the wall surfaces 2*a*, the gripping arms pointing outward and being arranged at an acute angle in relation to these wall surfaces.

The baseplate 4 has a marginal region 9 which points approximately perpendicularly upward and the axis of which is aligned essentially parallel to the axis of the roller spindle 3. The baseplate with the marginal region 9 is provided with a slot 10 which permits the hair strand to be inserted, is guided as far as the roller spindle 3 and partially surrounds the latter on both sides.

Furthermore, in the example illustrated, the baseplate has, in the transition to the marginal region 9, four exit openings 11 which each have a tapered bevel 13, which is set counter to the rolling direction illustrated by arrow 12 in FIG. 1, in such a manner that, during reverse rotation of the roller housing 2 counter to the rolling direction according to arrow 12, the gripping arms 8 can easily emerge to the outside. The beginning of this exit operation is indicated in FIG. 2.

Not illustrated specifically is the fact that the roller spindle 3 can be provided, for example at the free end, with a small latching bead in order to slightly fix the roller housing 2 in place in the usage position, with, however, the easy pulling off of the roller housing from the roller spindle 3 being ensured at the same time after the operation to treat the rolled-up hair strand has ended.

Figure 5:
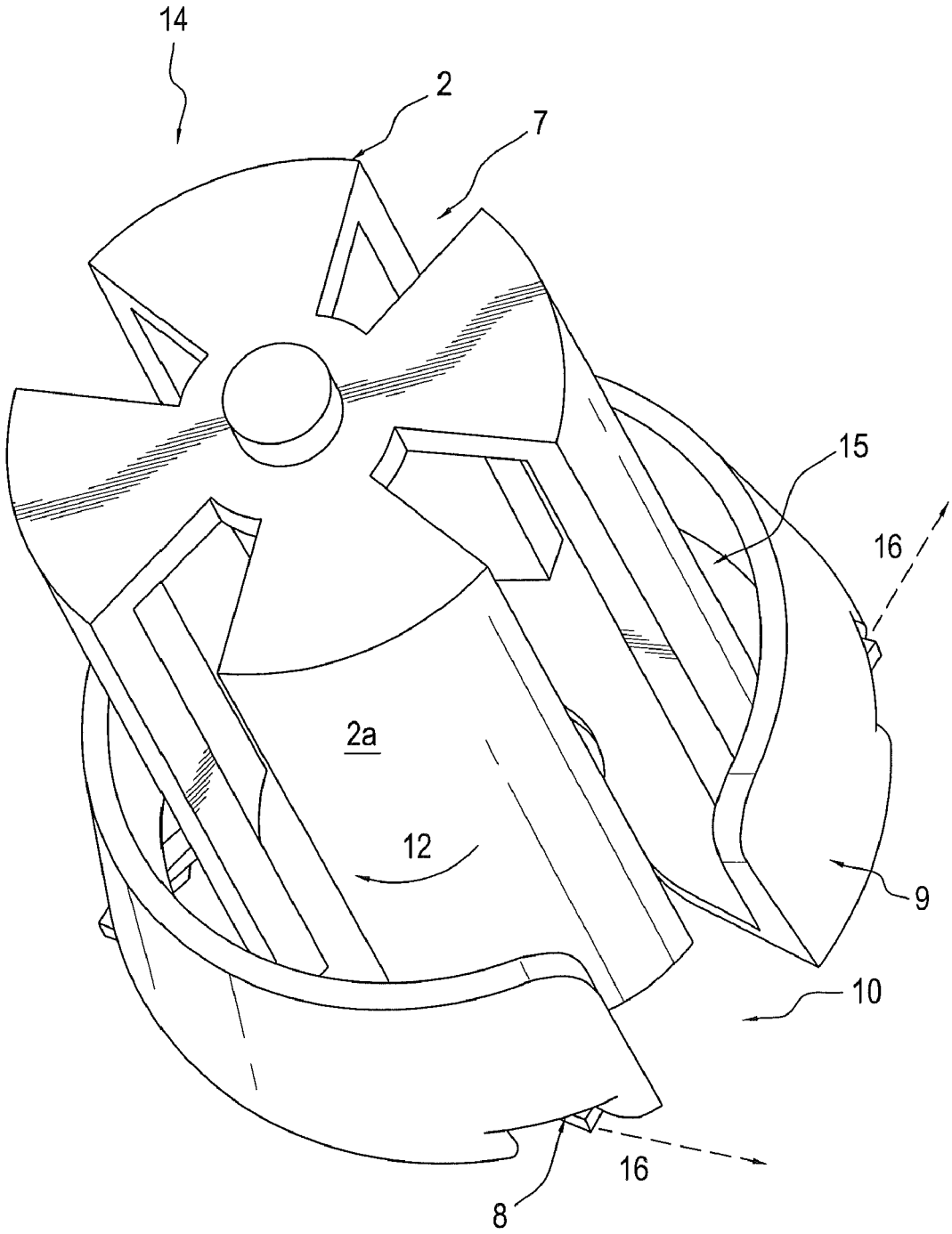
FIG. 5 shows an illustration according to FIG. 1 with a hair strand indicated.
Figure 6:
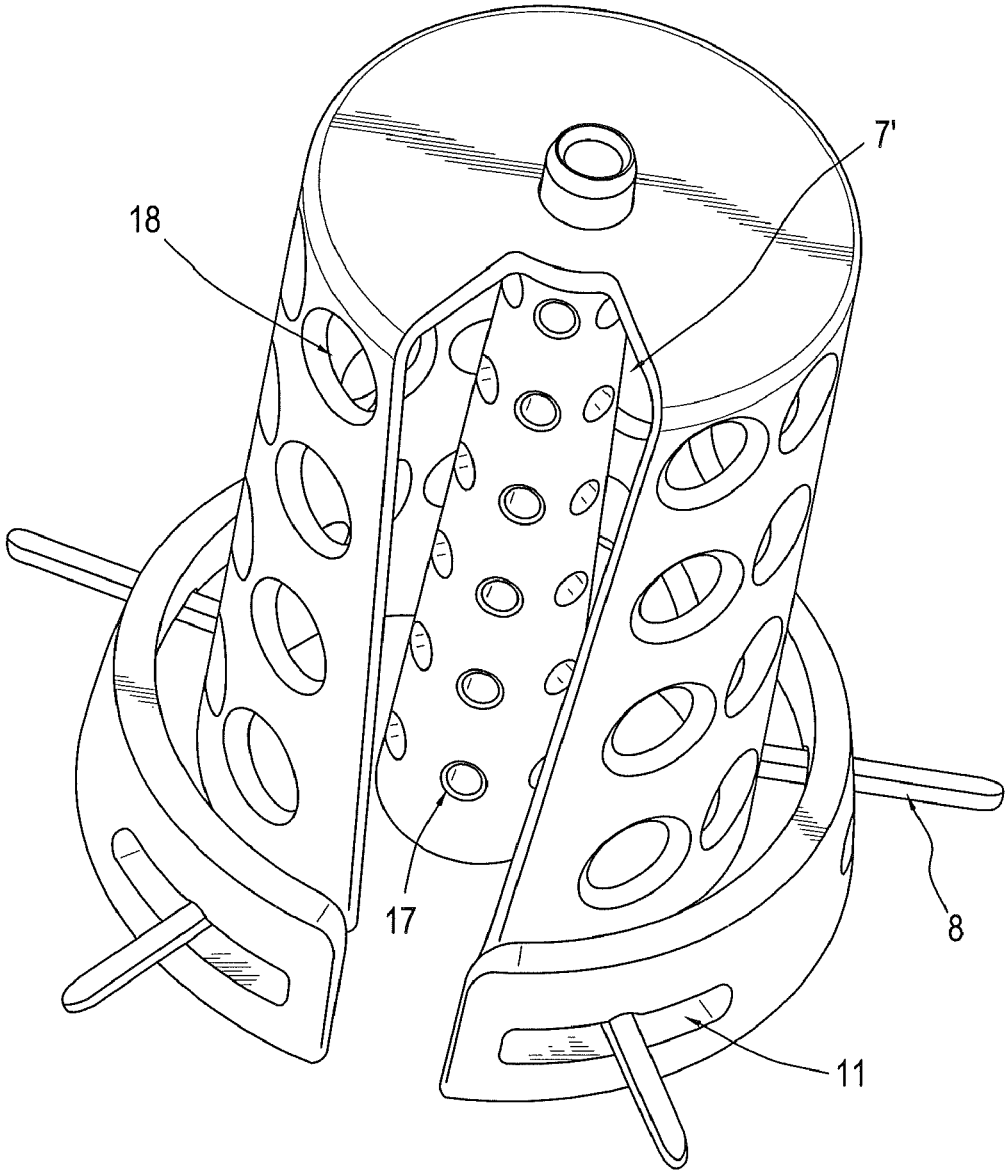
FIG. 6 shows a further embodiment of a hair roller according to the invention in oblique view.

The manner of operation of the device will be described in more detail here with reference to FIG. 5:

The user of a hair roller according to the invention forms, with the hair to be treated, a tuft of hair, referred to by 14 in FIG. 5, and places it through the slot 10 in the baseplate 4 into one of the four cutouts 7. The user subsequently rotates the roller housing 2 in the direction of the arrow 12, as a result of which the tuft of hair 14 is automatically rolled up within the roller housing on the roller spindle. The hair strand is guided during the rotation by means of a side surface of the slot 7. During the course of the rolling-up operation, the hair strand becomes shorter, to be precise until it is rolled completely around the roller spindle 3 within the roller housing 41.

If the tuft of hair 14 is completely rolled up on the roller spindle 3, a short reverse rotation counter to the direction of the arrow 12 suffices in order to allow the gripping arms 8 to emerge from the exit openings 11, which is indicated by small dashed arrows 16 in FIG. 5. The gripping arms then interlock in the surrounding hair root region.

FIGS. 6 to 9 show a further exemplary embodiment of the present invention. In the present exemplary embodiment, the roller housing 2 has just a single slot 7' which is widened in the upward direction. This widening of the slot 7' has the advantage that, during the rolling-up operation, the hair strand is guided by the side edge of this slot and, by means of the oblique configuration of this side edge, the hair strand is moved in the direction of the upper tip of the roller spindle 3 during the rolling-up operation. As a result, a purposeful rolling-up of the hair strand on the roller spindle 3 and the avoidance of a bunching of hair in the lower region of the roller spindle 3 can be obtained.

Figure 9:
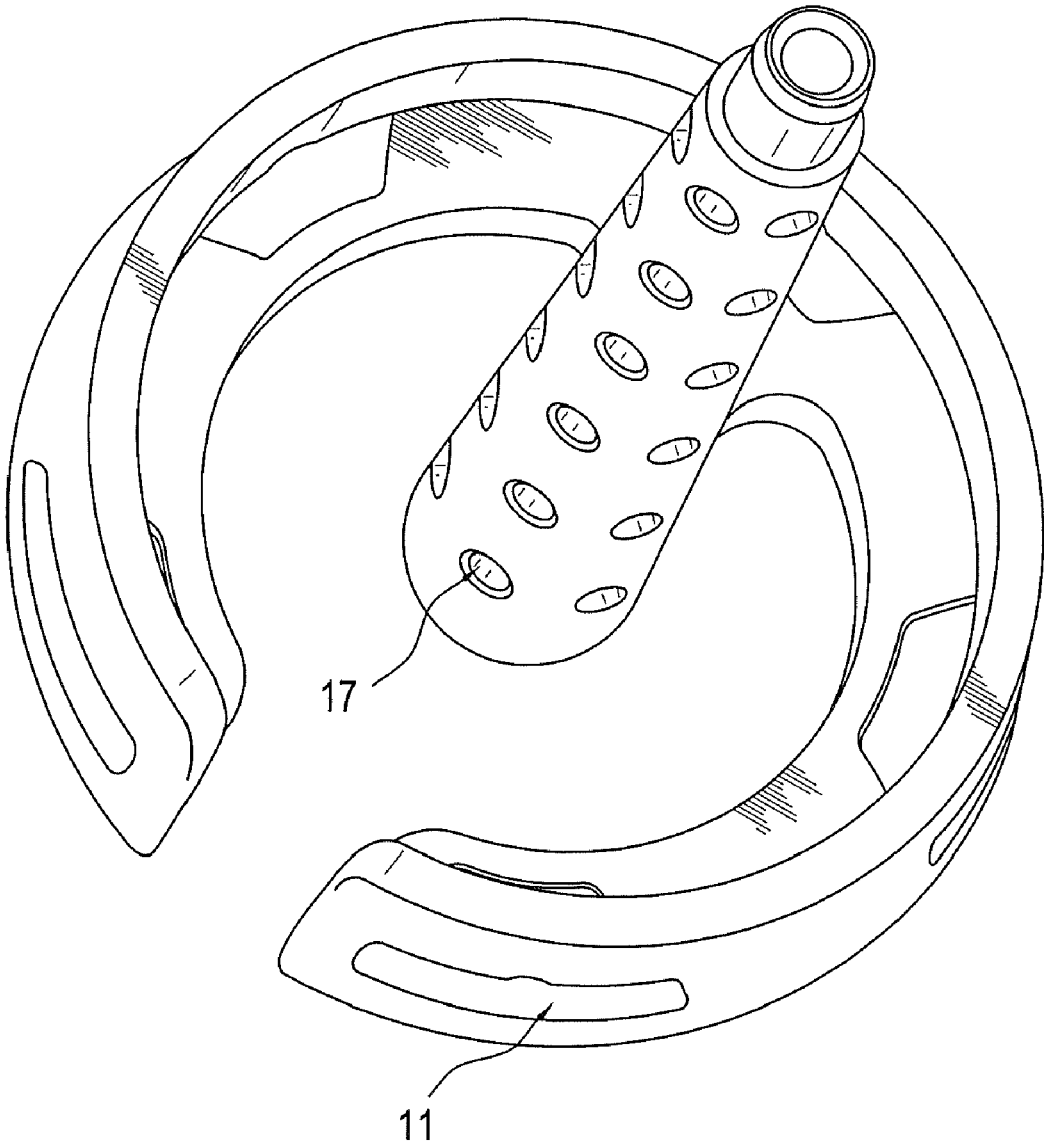
FIG. 9 shows a further configuration of a roller spindle according to the invention with baseplate.
Figure 10:
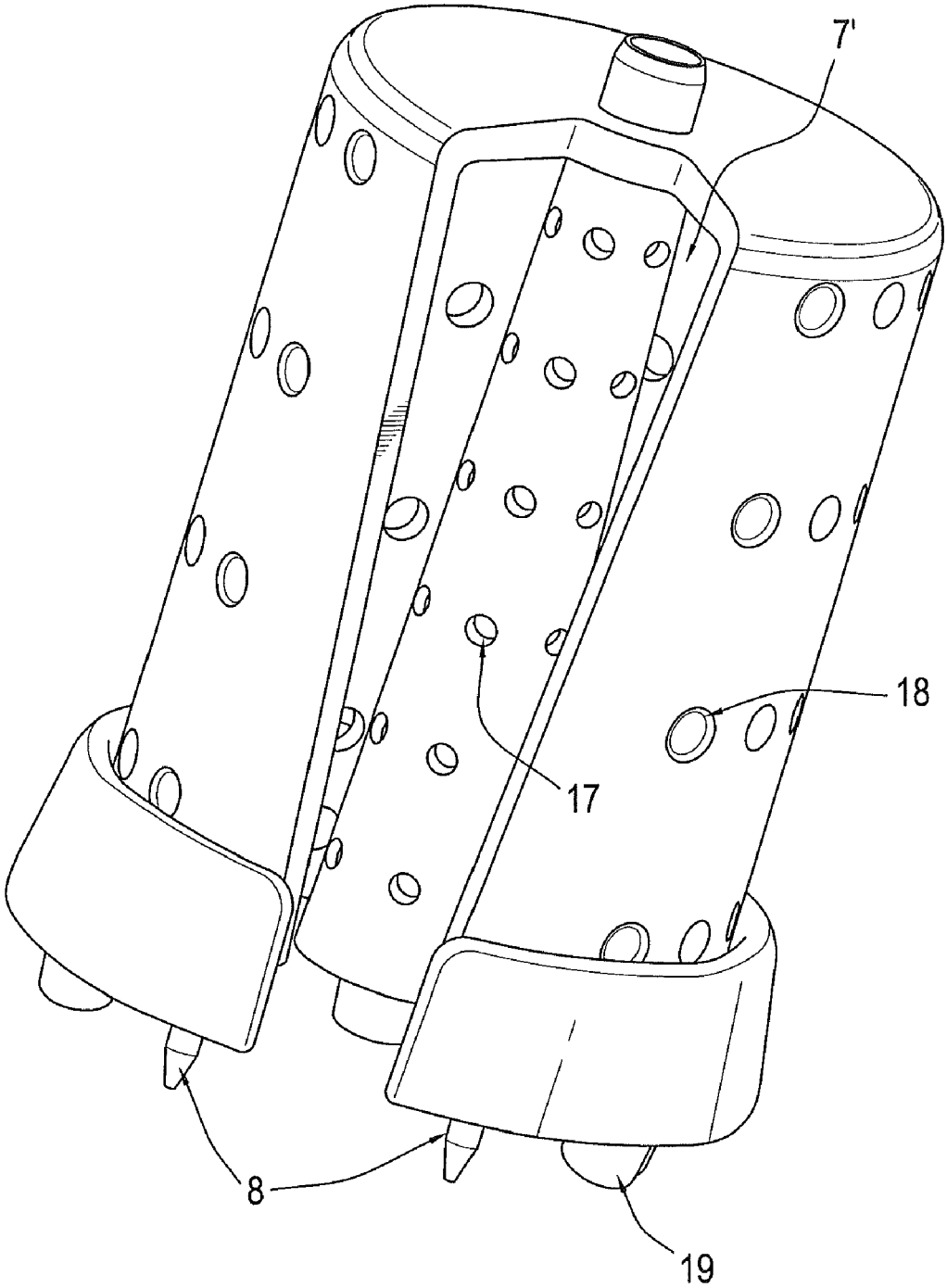
FIG. 10 shows a further embodiment of a hair roller according to the invention in oblique view.
Figure 11:
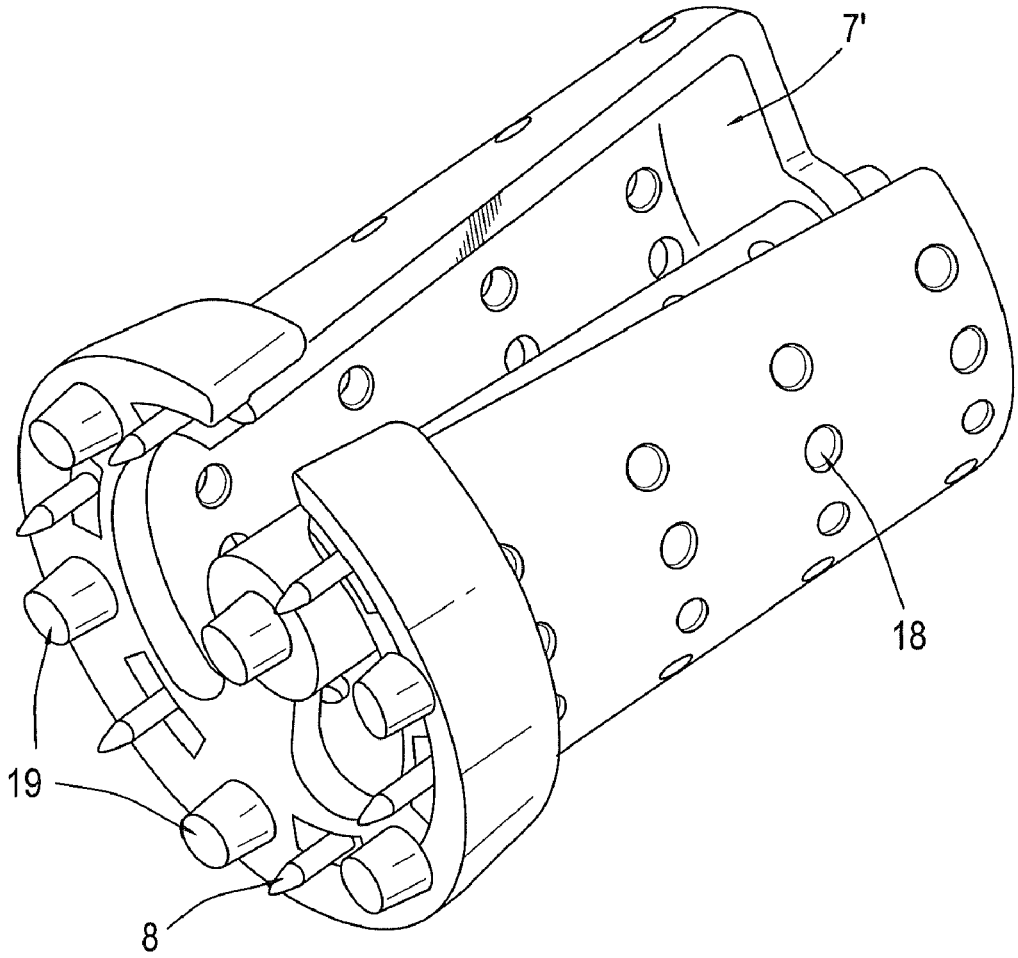
FIG. 11 shows a further embodiment of a hair roller according to the invention in a view from below.

As can be seen in FIG. 9, in the present exemplary embodiment the roller spindle 3 is of hollow design. In addition to the central bore, this roller spindle also has radial bores with openings 17. It is therefore possible to subject a rolled-up hair strand to the desired product from the inside of the roller spindle 3. This direct application of the product means that substantially less product is required.

After the desired action time, the applied product can be rinsed out again through the central bore in the roller spindle 3 and the openings 17 in the radial bores. The purposeful rinsing out ensures that virtually no permanent-wave-producing product remains in the hair after the action time.

Figure 8:
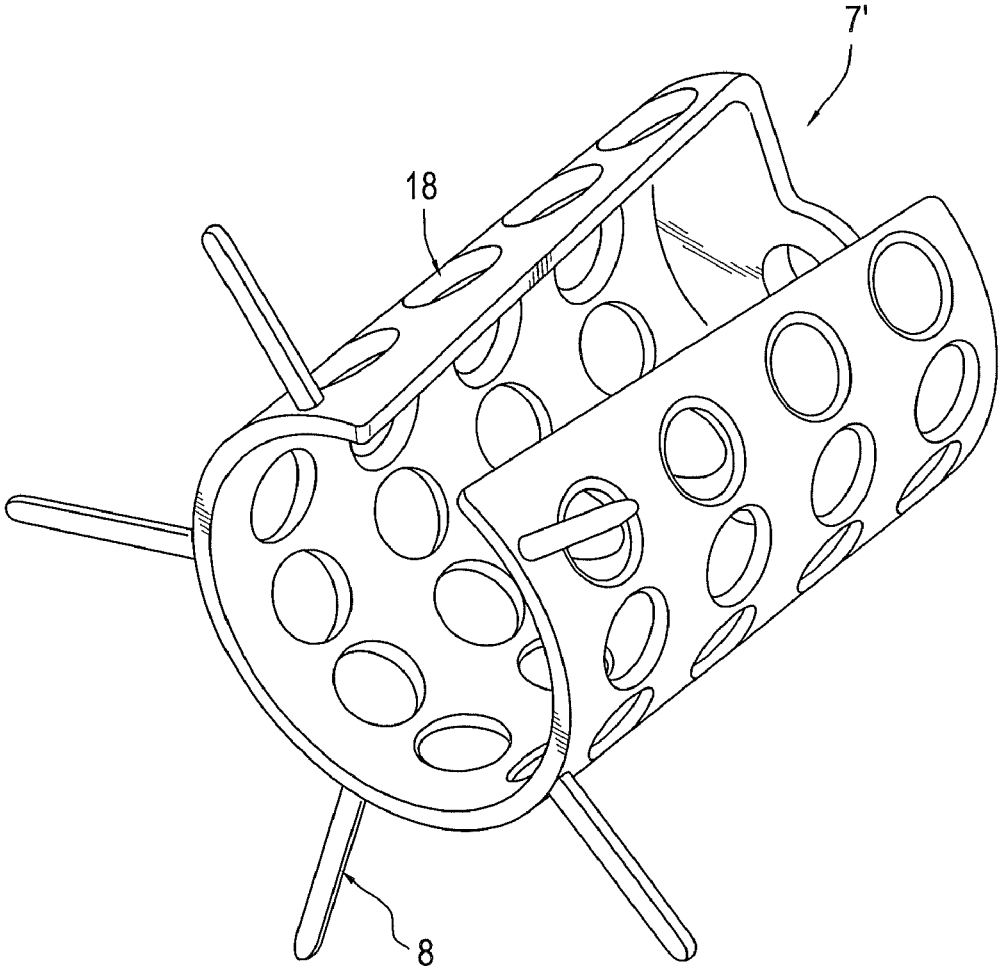
FIG. 8 shows a further embodiment of a roller housing according to the invention.

In order to further improve this rinsing out, in the case of the present exemplary embodiment of the invention, as illustrated, for example, in FIG. 8, openings 18 are also provided in the roller housing 2.

Figure 7:
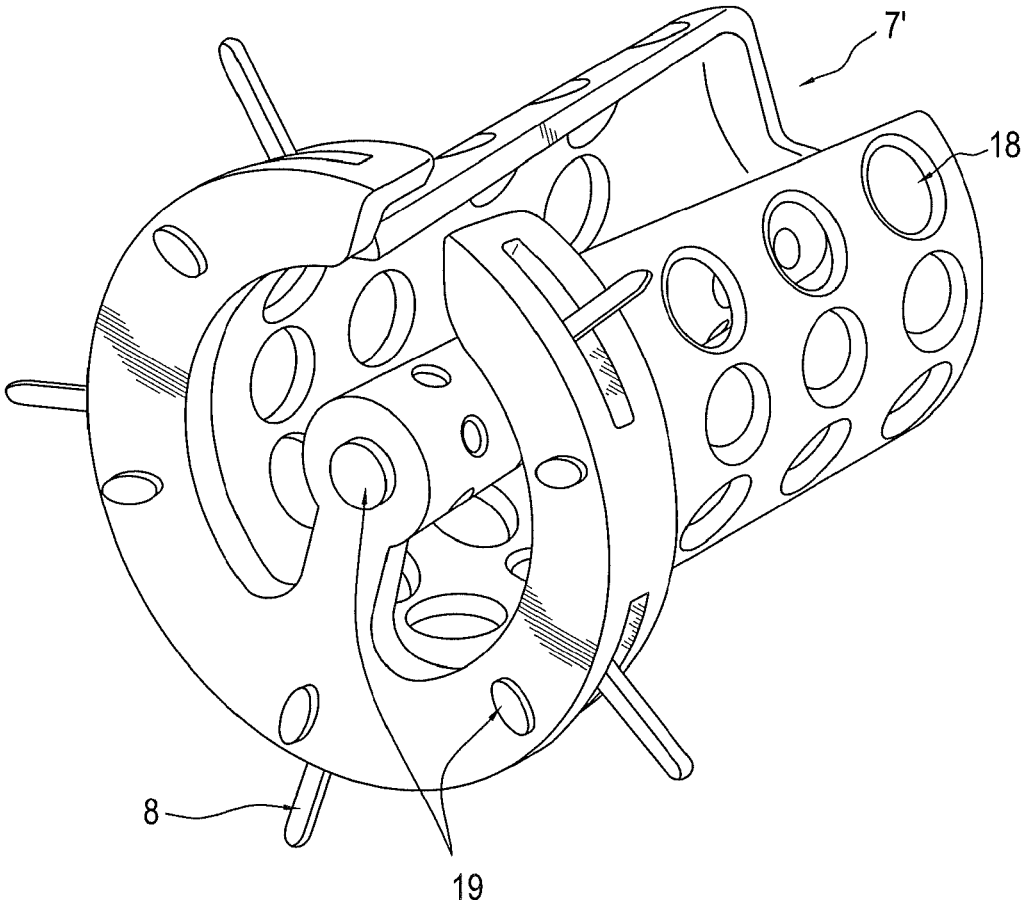
FIG. 7 shows a further embodiment of a hair roller according to the invention in a view from below.

FIG. 7 shows the view from below of this embodiment of the invention. The baseplate 4 is of concave configuration here and therefore matched to the shape of the head. Furthermore, distancing feet 19 have been arranged on this concave baseplate 4, by means of which a hair reservoir is formed under the baseplate when the roller 1 is placed on the head. As a result, the part of the hair strand which comes to lie under the baseplate is not clamped and therefore a bunching of the hair is avoided.

In order to design the use to be as simple as possible for the user, in the present embodiment the slot 10 in the base plate has been selected to be very large, namely to extend virtually over the entire baseplate 4.

In order to give the user even more freedom when using the hair roller, the gripping arms 8 are arranged such that they stand outward at right angles on the roller housing 2. This means that the direction of rotation of the roller housing 2 can be chosen freely depending on the preference of the user. The gripping arms 8 are bent by the insertion of the roller housing 2 onto the roller spindle 3 and the baseplate 4 in the marginal region 9 and, after the rolling operation is ended, are guided through the exit openings 11 to the outside into the hair lying around them.

In order, after the action time, to be able more easily to remove the finished curl from the roller spindle, in the present embodiment of the invention, as illustrated in FIG. 9, the roller spindle 3 is configured such that it tapers conically in the upward direction.

A further possible embodiment of the present invention is illustrated in FIGS. 10 to 13.

In contrast to the embodiment just described, the openings 18 in the roller housing 2 are designed to be significantly smaller. This results in a very closed surface of the roller housing around the roller spindle. In the case of the present exemplary embodiment, the heat produced by the action of, for example, permanent-wave-producing products on the hair can accordingly be removed less rapidly. If, furthermore, the roller housing 2 of the present embodiment is also provided with a thermal insulation in the form of a coating or by means of a suitable choice of material, the increased temperature within the roller housing can significantly shorten the action time on the hair strand and therefore the entire duration of use.

Figure 12:
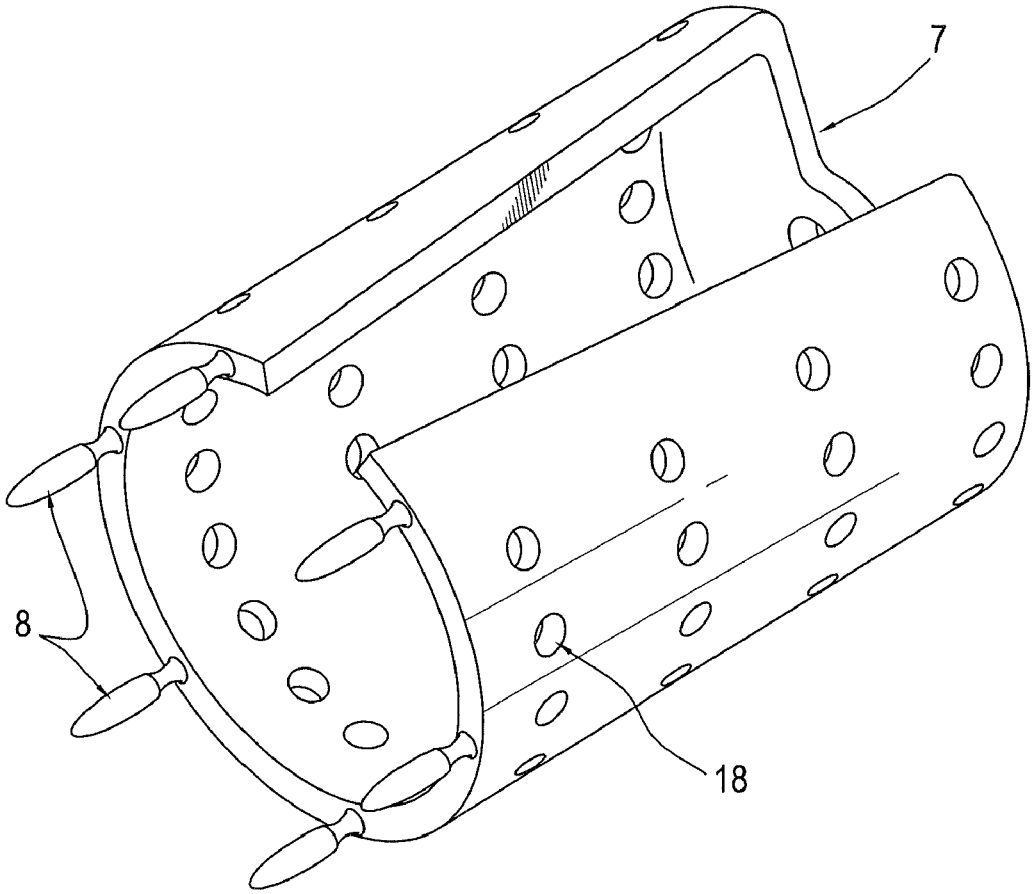
FIG. 12 shows a further embodiment of a roller housing according to the invention.
Figure 13:
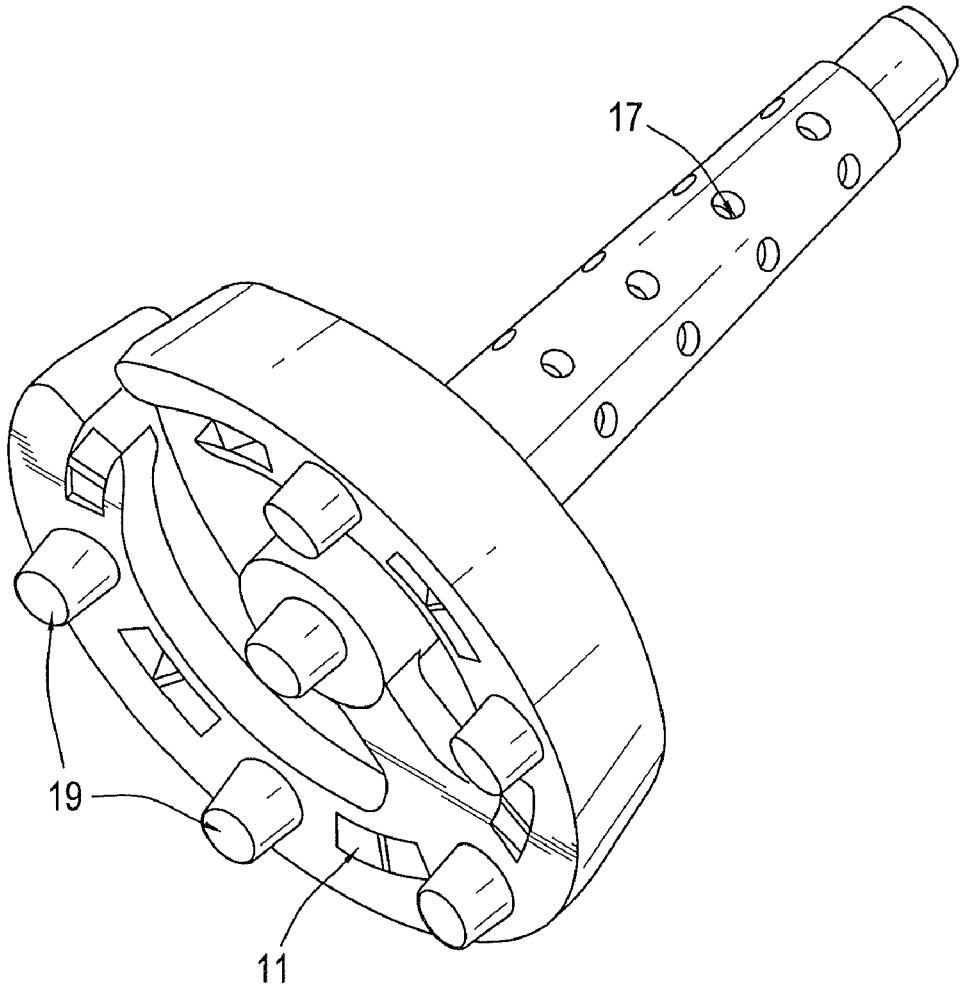
FIG. 13 shows a further embodiment of a roller spindle according to the invention with the baseplate, in a view from below.

FIG. 12 illustrates a further exemplary embodiment of a novel roller housing 2 of the present invention. The gripping arms 8 extend downward here parallel to the central axis of rotation of the roller housing. The exit openings 11 are also not arranged in the marginal region 9 but rather in the baseplate 4. This means that, after the rolling-up operation is ended, the reverse rotation of the roller housing 2 causes the gripping arms 8 not to engage in the hair situated around them but rather in that part of the rolled-up hair strand which is situated in the hair reservoir under the baseplate 4. It is therefore possible in the present embodiment to place a plurality of hair rollers substantially closer to one another on the head.

Furthermore, the gripping arms 8 of the present embodiment are also equipped with tapers which further facilitate a bending away of the gripping arms 8, which is required for the rotation of the roller housing 2.

Of course, the described exemplary embodiments of the invention can also be modified in many respects or can be combined with one another without departing from the basic concept of the invention.

The invention claimed is:

1. A hair roller, comprising:

a centric roller spindle having an upper end and a lower end, a base plate extending from the centric roller spindle, which base plate has an entry slot for a hair strand and is provided with an upwardly aligned marginal web and with pass-through openings with tapered bevels in a transition region between the base plate and the marginal web, and a partially slotted cylindrical roller housing which surrounds the centric roller spindle at a distance, which cylindrical housing is provided with at least one slot, and having gripping arms with free ends extending from a marginal region to fix the hair roller onto hairs close to the scalp, which marginal region, in the hair roller usage position, rests on the base plate, and which free ends of the gripping arms fit into the pass-through openings in the base plate, and in the final rolling position, said gripping arms being positioned approximately perpendicular to the scalp.

2. The hair roller as claimed in claim 1, characterized in that the gripping arms are set at an angle of maximally 90° relative to an outer casing region of the roller housing.

3. The hair roller as claimed in claim 1, characterized in that the number of pass-through openings is greater than the number of gripping arms.

4. The hair roller as claimed in claim 1, characterized in that the roller housing is fixed in the usage position to the spindle or base plate by latching or clamping.

5. The hair roller as claimed in claim 1, characterized in that the roller spindle is conically configured.

6. The hair roller as claimed in claim 1, characterized in that the roller spindle has low friction surface.

7. The hair roller as claimed in claim 6, characterized in that the low-friction surface of the roller spindle is formed by a coating.

8. The hair roller as claimed in claim 1, characterized in that the roller spindle is made of a different material from the base plate.

9. The hair roller as claimed in claim 1, characterized in that the roller spindle has a structure on its surface.

10. The hair roller as claimed in claim 1, characterized in that the roller spindle is hollow on the inside.

11. The hair roller as claimed in claim 10, characterized in that the roller spindle is provided with radial bores.

12. The hair roller as claimed in claim 10, characterized in that the roller spindle defines an upper opening.

13. The hair roller as claimed in claim 11, characterized in that the bores are distributed on the roller spindle in order to produce more or less heavily waved areas on at least one strand.

14. The hair roller as claimed in claim 1, characterized in that the roller housing has at least one cutout which widens in the upward direction.

15. The hair roller as claimed in claim 14, characterized in that the cutout is a beveled slot, which has a gradient such that, by the rotation of the roller housing, one or more hair strands is/are transported in the direction of the upper end of the roller spindle.

16. The hair roller as claimed in claim 1, characterized in that the roller housing has openings.

17. The hair roller as claimed in claim 1, characterized in that the roller housing has a thermal insulation.

18. The hair roller as claimed in claim 17, characterized in that the roller housing consists of a heat-insulating material.

19. The hair roller as claimed in claim 17, characterized in that the roller housing has at least one heat-insulating coating.

20. The hair roller as claimed in claim 1, characterized in that the roller housing defines an internal volume, and said internal volume is matched to the length of the hair strand to be treated.

21. The hair roller as claimed in claim 1, characterized in that feet are fitted on the base plate of the roller spindle.

22. The hair roller as claimed in claim 21, characterized in that, as a result of the distancing of the base plate from the scalp, a hair reservoir is formed beneath the mounted hair roller.

23. The hair roller as claimed in claim 21, characterized in that the feet are made from a soft material which does not injure the scalp.

24. The hair roller as claimed in claim 1, characterized in that the base plate of the roller spindle has a concave curvature.

25. The hair roller as claimed in claim 1, characterized in that the gripping arms have tapers, which facilitate the engagement of the gripping arms in the exit openings.

26. The hair roller as claimed in claim 1, characterized in that the gripping arms extend from the roller housing downwards substantially parallel to the roller spindle.

27. The hair roller as claimed in claim 26, characterized in that the base plate defines exit openings integrated in the base plate, so that the gripping arms engage in the hairs of the hair reservoir situated beneath the roller spindle.

* * * * *